United States Patent [19]

Murphy

[11] Patent Number: 4,657,215

[45] Date of Patent: Apr. 14, 1987

[54] MOUNTING ASSEMBLY FOR HEATER THERMSTAT CONTROL

[75] Inventor: Mark A. Murphy, Franklin, Tenn.

[73] Assignee: Apcom, Inc., Franklin, Tenn.

[21] Appl. No.: 689,659

[22] Filed: Jan. 8, 1985

[51] Int. Cl.[4] ..... F24H 9/06

[52] U.S. Cl. ..... 248/221.3; 248/300; 211/26

[58] Field of Search ..... 248/225.2, 221.3, 300, 248/316.7; 211/26, 13; 219/328; 174/66, 67

[56] References Cited

U.S. PATENT DOCUMENTS

| | | | |
|---|---|---|---|
| 2,575,150 | 11/1951 | Wellman | 219/328 |
| 2,686,031 | 8/1954 | Bolesky | 248/300 X |
| 3,276,599 | 10/1966 | Them | 211/26 X |
| 3,883,717 | 5/1975 | Del Percio | 211/26 X |
| 3,992,608 | 11/1976 | Snavely | 211/26 X |
| 4,399,971 | 8/1983 | Fehrmann et al. | 248/225.2 X |

FOREIGN PATENT DOCUMENTS

| | | | |
|---|---|---|---|
| 676099 | 12/1963 | Canada | 248/300 |

*Primary Examiner*—Ramon S. Britts
*Assistant Examiner*—Karen J. Chotkowski
*Attorney, Agent, or Firm*—Fuller, Puerner & Hohenfeldt

[57] ABSTRACT

A thermostat control for an electric water heater is held in firm contact with the heater storage tank by a mounting assembly comprising a tank bracket including a body having an opening adapted to lockingly fit over the heater tank stud and a pair of laterally-spaced legs extending from the body and having a bent upper end portion adapted to apply spring pressure toward the tank outer wall. The mounting assembly also includes a thermostat bracket carrying the thermostat control and having a pair of laterally-spaced, upstanding ears adapted to fit beneath the upper end portion of the legs on the tank bracket. Each of the ears includes a nib which is received in a slot in the legs on the tank bracket to interlock the two brackets. The tank bracket has a retaining lip located between the laterally-spaced legs which is positioned to tightly bear against the end wall of the thermostat control when the parts are in assembled position and an outward horizontal load is applied.

2 Claims, 3 Drawing Figures

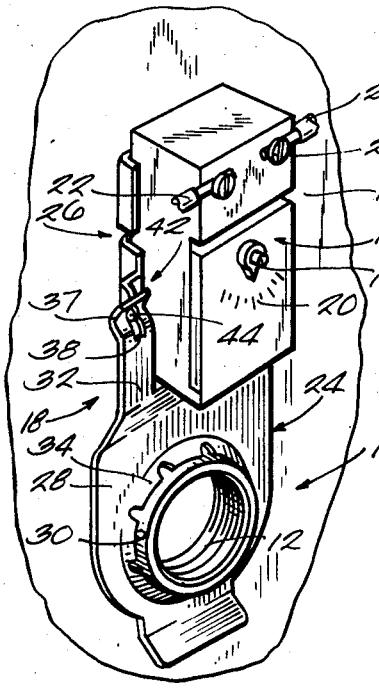
Fig. 1
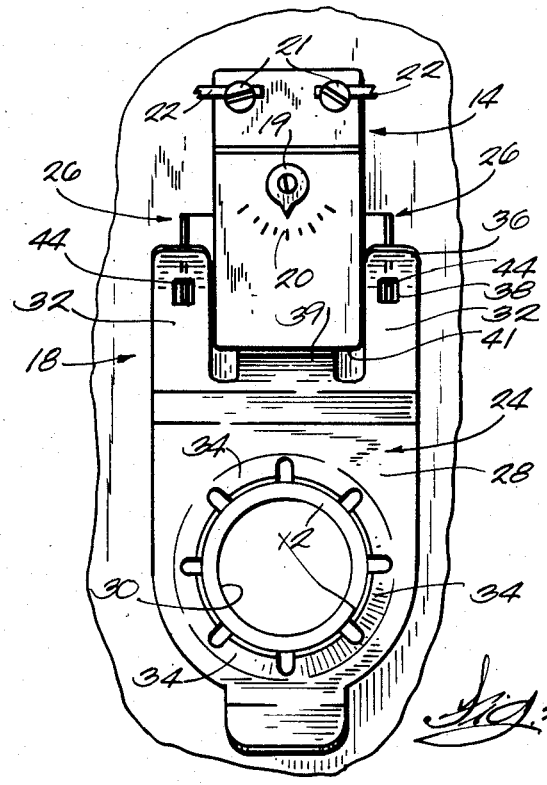
Fig. 2
Fig. 3
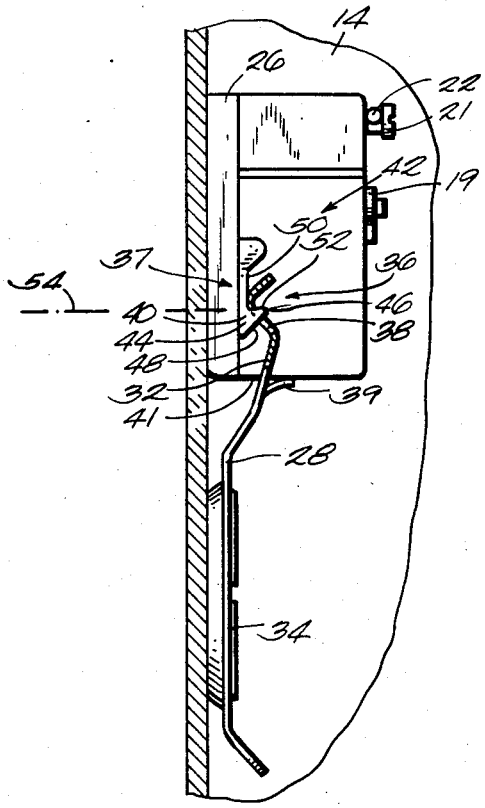

MOUNTING ASSEMBLY FOR HEATER THERMSTAT CONTROL

BACKGROUND OF THE INVENTION

This invention relates to mounting assemblies for temperature controls for heater tanks and, more particularly, to assemblies for mounting thermostat controls on the outer wall of the storage tanks of electric water heaters. The mounting assembly of the present invention is an improvement of the assembly shown in U.S. Pat. No. 4,399,971.

SUMMARY OF THE INVENTION

The mounting assembly provided by the invention comprises a first or tank bracket including a body having an opening adapted to lockingly fit over the heater tank spud and a pair of laterally-spaced legs extending from the body and having a bent upper end portion adapted to apply spring pressure toward the tank outer wall when the first bracket is locked on the tank spud. Each of the legs includes an elongated slot in the upper end portion. The mounting assembly also includes a second or thermostat bracket carrying the thermostat control and having a pair of laterally-spaced, upstanding ears adapted to fit beneath the upper end portion of the legs. Each of the ears includes a nib received in a leg slot to interlock the two brackets. The nib has an upper edge which engages the upper end of the slot and is arranged to urge the thermostat bracket into firmer contact with the tank in response to upward vertical movement of the thermostat bracket relative to the tank bracket.

The assembly is further characterized by a retaining lip on the tank bracket which is located between the legs of the bracket and positioned to bear against the end wall of the thermostat control when the parts are in assembled position and an outward horizontal load is applied.

BRIEF DESCRIPTION OF THE DRAWING

FIG. 1 is a perspective view of a mounting assembly of the invention with a thermostatic control installed on a storage tank of an electric water heater;

FIG. 2 is a top plan view of the mounting assembly shown in FIG. 1; and

FIG. 3 is an enlarged, fragmentary, partially sectioned, side view of the mounting assembly shown in FIG. 1.

DESCRIPTION OF THE PREFERRED EMBODIMENT

Illustrated in the drawing is a storage tank 10 (illustrated fragmentarily in FIG. 1) for an electric water heater including an internally threaded spud 12 which receives an electrical heating element (not shown).

A conventional thermostat control 14 is held in firm contact with the outer surface 16 of the heater storage tank 10 by a mounting assembly 18 embodying the invention. The thermostat control 14 includes an adjustment knob 19 and a temperature-indicating dial 20. The thermostat control 14 also includes a pair of electrical terminals 21 and can be connected to the supply wiring via a pair of pigtail leads 22 fastened on the terminals 21.

The mounting assembly 18 includes a first or tank bracket 24 and a second or thermostat bracket 26 carrying the thermostat control 14. The tank bracket 24 is made from a spring material (e.g., 0.020-inch high carbon spring steel), has a main body 28 including a circular opening 30 adapted to lockingly fit over the tank spud 12, and has a pair of laterally-spaced fingers or legs 32 extending from the body 28.

In the specific construction illustrated, the opening 30 is surrounded by a plurality of circumferentially-spaced, partially out-turned leaves 34 which, prior to installation, define a circular opening having an inside diameter somewhat smaller than the outside diameter of the tank spud 12. The tank bracket 24 is installed by forcing the leaves 34 down over the tank spud 12 and the leaves 34 thereafter bite into or wedge onto the tank spud 12 to secure the tank bracket 24 in place.

The legs 32 on the tank bracket 24 have a bent upper end portion 36 adapted to apply spring pressure, via a bight portion 37, in a direction toward the outer surface 16 of the storage tank 10 when the tank bracket 24 is installed on the tank spud 12. The upper end portion 36 of each leg 32 includes a narrow, elongated slot 38 having an upper end 40.

The thermostat bracket 26 includes a pair of laterally-spaced, upstanding ears 42 adapted to fit beneath the upper end portion 36 of the legs 32. The lower end portion of each ear 42 is in the form of a nib 44 which extends through the slot 38 in a leg 32 to interlock the thermostat bracket 26 with the tank bracket 24. The nib 44 has an outer tip portion 46 and an inclined lower edge 48 which serves as a camming surface for the bight portion 37 on the leg 32 as the ears are moved (vertically downwardly) beneath the legs 32 to interlock the thermostat bracket 26 with the tank bracket 24. After the nibs 44 are received in the slots 38, the bight portions 37 apply a spring pressure on a generally straight ledge 50 on each ear 42 and thereby hold the back side of the thermostat bracket 26 in firm contact with the outer surface 16 of the storage tank 10. As is the usual case, the thermostat bracket 26 can include one or more openings (not shown) in the back side for permitting direct exposure of the temperature sensitive element (not shown) of the thermostat control 14 to the outer surface 16 of the storage tank 10.

To provide a greater holding force of the tank bracket 24 on the thermostat bracket 26, the tank bracket 24 is provided with a retaining lip portion 39. Lip portion 39 is located intermediate legs 32 and angles upwardly from the face of the tank bracket 24. Thus (as best shown in FIG. 3), when the legs 32 are interlocked with the upstanding ears 42 as described above, retaining lip portion 39 will bear against the end wall 41 of thermostat control 14. Lip 39 is dimensioned so that when the tank bracket 24 is pressed into its assembled position on spud 12 and an outward horizontal load is applied, the lip 39 will be bowed slightly downwardly to thus apply a spring pressure on the wall 41 of the thermostatic control 14. The overall effect is to provide a secure clamping action between the parts to thereby virtually eliminate inadvertent disconnection of the thermostat control 14 from the tank bracket 24.

Conventional mounting assemblies are arranged so that an installer pulling on the pigtail leads 22, while connecting them to the supply wiring, can accidently disconnect the thermostat bracket 26 from the tank bracket 24. This problem is obviated by providing the nib 44 with an upper edge 52 which engages the upper end of the slot 38 and is arranged to urge the thermostat bracket 26 into firmer contact with the outer surface 16 of the storage tank 10 in response to upward vertical movement of the thermostat bracket 26 relative to the tank bracket 24.

In the specific construction illustrated, the upper edge 52 of the nib 44 is downwardly inclined in a direction from the tip portion 46 toward the storage tank 10. While this incline can vary somewhat, the upper edge 52 preferably extends from the tip portion 46 at an angle of about 10° relative to a plane (designated by reference numeral 54) extending generally perpendicularly to the center line of the storage tank 10 as illustrated in FIG. 2. With this arrangement, pulling on the pigtail leads 22 does not cause the thermostat bracket 26 to become disconnected from the tank bracket 24. Instead, this pulling movement causes a camming effect between the upper edge 52 of the nib 46 and the front edge 40 of the slot 38 which tends to move the thermostat bracket 26 into firmer contact with the outer wall of the storage tank.

For installation, the tank bracket 24 is first installed by forcing the leaves 34 down over the tank spud 12. The thermostat bracket 26 carrying the thermostat control 14 is interlocked with the tank bracket 24 by moving the lower edges 48 of the nibs 44 into engagement with the upper ends of the legs 32 and pushing downward on the thermostat bracket 26 until the nibs 44 snap into the slots 38. The bight portions 37 of the legs 32 bear against the ear ledges 50 and keep the thermostat bracket 26 in firm contact with the storage tank 10 and the nibs 44 cooperate with the slots 38 to prevent undue vertical and lateral movement. Retaining lip 39 provides an additional holding force as explained previously.

A faulty thermostat control can be removed by lifting the legs 32 sufficiently to disengage the nibs 44 from the slots 38. As indicated previously, the combined holding action of legs 32 and lip 39 prevent the pulling of the thermostat from underneath the tank bracket 24 with other than the application of a substantial pulling force (in excess of 5 lbs).

From the foregoing description, one skilled in the art can easily ascertain the essential characteristics of this invention and, without departing from the spirit and scope thereof, make various changes and modifications to adapt it to various usages.

I claim:

1. An assembly for mounting a thermostat control on the outer wall of a heater tank including an external spud in which a heating element is mounted, said mounting assembly comprising a first bracket made from a spring material and including a body having an opening adapted to lockingly fit over the tank spud, said first bracket further including a pair of laterally-spaced legs extending from said body and having a bent upper end portion adapted to apply spring pressure toward the tank outer wall when said first bracket is locked on the tank spud, each of said legs including in said upper end portion an elongated slot having an upper end;

a second bracket carrying the thermostat control and having a pair of laterally-spaced, upstanding ears adapted to fit beneath the upper end portions of said legs, each of said ears including a nib received in a said slot for interlocking said first and said second brackets and having an upper edge adapted to engage the upper end of said slot and cooperate therewith to urge the thermostat control into firmer contact with the tank outer wall in response to upward vertical movement of said second bracket relative to said first bracket; and said assembly further characterized by a retaining lip on said first bracket, said lip located between said legs and positioned to bear against the end wall of the thermostat control when the parts are in assembled position and an outward horizontal load is applied.

2. A mounting assembly according to claim 1 wherein said retaining lip on said first bracket is made from a spring material which will be bowed slightly downwardly to apply a spring pressure on the end wall of the thermostat control.

* * * * *